US009328742B2

(12) United States Patent
Yamada et al.

(10) Patent No.: US 9,328,742 B2
(45) Date of Patent: May 3, 2016

(54) EJECTOR

(71) Applicant: DENSO CORPORATION, Kariya, Aichi (JP)

(72) Inventors: Etsuhisa Yamada, Kariya (JP); Haruyuki Nishijima, Obu (JP); Yoshiaki Takano, Kosai (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 14/413,298

(22) PCT Filed: May 28, 2013

(86) PCT No.: PCT/JP2013/003361
§ 371 (c)(1),
(2) Date: Jan. 7, 2015

(87) PCT Pub. No.: WO2014/010162
PCT Pub. Date: Jan. 16, 2014

(65) Prior Publication Data

US 2015/0176606 A1 Jun. 25, 2015

(30) Foreign Application Priority Data

Jul. 9, 2012 (JP) ..... 2012-153320

(51) Int. Cl.
*F25B 9/08* (2006.01)
*F04F 5/46* (2006.01)
(Continued)

(52) U.S. Cl.
CPC . *F04F 5/461* (2013.01); *F04F 5/18* (2013.01); *F04F 5/20* (2013.01); *F04F 5/42* (2013.01);
(Continued)

(58) Field of Classification Search
CPC ..... F25B 9/08; F25B 2341/0012; F25B 2341/0011
See application file for complete search history.

(56) References Cited

U.S. PATENT DOCUMENTS

2001/0025499 A1* 10/2001 Takeuchi ..... F25B 1/08 62/175
2007/0271942 A1* 11/2007 Yokoyama ..... F25B 41/00 62/278
2012/0085124 A1 4/2012 Maruyama et al.

FOREIGN PATENT DOCUMENTS

JP 3331604 B2 10/2002
JP 2007120441 A 5/2007
(Continued)

OTHER PUBLICATIONS

International Search Report and Written Opinion (in Japanese with English Translation) for PCT/JP2013/003361, mailed Aug. 27, 2013; ISA/JP.
(Continued)

*Primary Examiner* — Cassey D Bauer
(74) *Attorney, Agent, or Firm* — Harness, Dickey & Pierce, P.L.C.

(57) ABSTRACT

A refrigerant passage formed between an inner peripheral surface of a decompression space formed within a body part and an outer peripheral surface of a valve body that changes a refrigerant passage area of a minimum area part functions as a nozzle, and a refrigerant passage formed between an inner peripheral surface of a pressure increase space formed within the body part and an outer peripheral surface of a passage formation member functions as a diffuser to configure an ejector. Further, the valve body and the passage formation member are provided as separated members, and a load of the refrigerant on the valve body is reduced, thereby being capable of downsizing a drive device that displaces the valve body.

9 Claims, 9 Drawing Sheets

(51) Int. Cl.

| | |
|---|---|
| ***F04F 5/18*** | (2006.01) |
| ***F25B 41/00*** | (2006.01) |
| ***F04F 5/50*** | (2006.01) |
| ***F25B 1/00*** | (2006.01) |
| ***F25B 41/06*** | (2006.01) |
| ***F04F 5/20*** | (2006.01) |
| ***F04F 5/42*** | (2006.01) |
| *F25B 27/00* | (2006.01) |
| *F25B 40/02* | (2006.01) |

(52) U.S. Cl.

CPC ... *F04F 5/50* (2013.01); *F25B 1/00* (2013.01); *F25B 41/00* (2013.01); *F25B 41/062* (2013.01); *F25B 27/00* (2013.01); *F25B 40/02* (2013.01); *F25B 2327/001* (2013.01); *F25B 2341/0012* (2013.01); *F25B 2400/23* (2013.01); *F25B 2500/18* (2013.01)

(56) References Cited

FOREIGN PATENT DOCUMENTS

| | | | |
|---|---|---|---|
| JP | 2010019133 | A | 1/2010 |
| JP | 2012097733 | A | 5/2012 |

OTHER PUBLICATIONS

U.S. Appl. No. 14/373,862, filed Jul. 22, 2014, Yamada et al.

* cited by examiner

EJECTOR

CROSS REFERENCE TO RELATED APPLICATIONS

This application is a U.S. National Phase Application under 35 U.S.C. 371 of International Application No. PCT/JP2013/003361 filed on May 28, 2013 and published in Japanese as WO 2014/010162 A1 on Jan. 16, 2014. This application is based on and claims the benefit of priority from Japanese Patent Application No. 2012-153320 filed on Jul. 9, 2012. The entire disclosures of all of the above applications are incorporated herein by reference.

TECHNICAL FIELD

The present disclosure relates to an ejector that decompresses a fluid, and sucks the fluid by a suction action of an injection fluid ejected at high speed.

BACKGROUND ART

Up to now, an ejector has been known as a decompressor applied to a refrigeration cycle device of a vapor compression type. The ejector of this type has a nozzle portion that decompresses refrigerant, sucks a gas-phase refrigerant which flows out from an evaporator by a suction action of an ejected refrigerant ejected from the nozzle portion, mixes the ejected refrigerant with the sucked refrigerant in a pressure increase part (diffuser portion), thereby being capable of boosting the pressure.

Therefore, in the refrigeration cycle device having the ejector as the decompressor (hereinafter referred to as "ejector type refrigeration cycle"), a motive power consumption of the compressor can be reduced with the use of the refrigerant boost action in a pressure increase part of the ejector, and a coefficient of performance (COP) of the cycle can be improved as compared with a normal refrigeration cycle device having an expansion valve as the decompressor.

Further, Patent Document 1 discloses the ejector applied to the refrigeration cycle device with the nozzle portion which decompresses the refrigerant in two stages. In more detail, in the ejector of Patent Document 1, the refrigerant of a high pressure liquid-phase state is decompressed into a gas-liquid two-phase state in a first nozzle, and the refrigerant of the gas-liquid two-phase state flows into a second nozzle.

With the above configuration, in the ejector of Patent Document 1, boiling of the refrigerant in the second nozzle is facilitated to improve a nozzle efficiency as the overall nozzle portion, and the COP is to be further improved as the overall ejector type refrigeration cycle. Meanwhile, the nozzle efficiency represents an energy conversion efficiency in converting a pressure energy of the refrigerant into a kinetic energy in the nozzle portion.

PRIOR ART DOCUMENT

Patent Document

Patent Document 1: Japanese Patent No. 3331604

SUMMARY OF THE INVENTION

However, according to the present inventors' study, in the ejector of Patent Document 1, for example, when a heat load of the ejector type refrigeration cycle becomes low, and a pressure difference (a difference between a high pressure and a low pressure) between a pressure of a high-pressure side refrigerant and a pressure of a low-pressure side refrigerant in the cycle is reduced, the pressure may be reduced by the difference between the high pressure and the low pressure in the first nozzle, and the pressure of the refrigerant may be hardly reduced in the second nozzle. In this case, a nozzle efficiency improvement effect by allowing the gas-liquid two-phase state refrigerant to flow into the second nozzle may not be obtained.

On the contrary, the present inventors have proposed, in JP 2012-20882 A (hereinafter referred to as "earlier application example") in advance, an ejector including a body part having a swirling space in which a refrigerant flowing out from a radiator is swirled, a decompression space in which the refrigerant flowing out from the swirling space is decompressed, a suction passage that communicates with a refrigerant flow downstream side of the decompression space, and sucks the refrigerant flowing out from the evaporator, and a pressure increase space in which the ejected refrigerant ejected from the decompression space is mixed with the sucked refrigerant sucked from the suction passage to boost the pressure, formed therein, a conically shaped valve body that is arranged within the decompression space and the pressure increase space, forms a minimum area part in which a refrigerant passage area is most reduced within the decompression space, and forms a refrigerant passage in which the refrigerant passage area gradually enlarges toward the refrigerant flow downstream side within the pressure increase space, and a drive device that displaces the valve body, in which a refrigerant passage formed between an inner peripheral surface of the decompression space and an outer peripheral surface of the valve body functions as a nozzle that decompresses and ejects the refrigerant, and a refrigerant passage formed between an inner peripheral surface of the pressure increase space and an outer peripheral surface of the valve body functions as a diffuser that converts a velocity energy of the ejected refrigerant and the sucked refrigerant into a pressure energy.

In the ejector of the earlier application example, the refrigerant swirls in the swirling space with the results that a refrigerant pressure on a swirling center side within the swirling space is reduced to a pressure of a saturated liquid-phase refrigerant, or a pressure at which the refrigerant is decompressed and boiled (cavitation occurs). In addition, the refrigerant on the swirling center side where the pressure is reduced flows into the decompression space, and the refrigerant is surely decompressed and boiled in the vicinity of the minimum area part within the decompression space. With the above configuration, the energy conversion efficiency (corresponding to the nozzle efficiency) in the refrigerant passage that functions as the nozzle within the decompression space is improved.

Further, the drive device displaces the valve body according to a heat load of the ejector type refrigeration cycle to change the refrigerant passage area of the refrigerant passage that functions as the nozzle within the decompression space, and the refrigerant passage area of the refrigerant passage that functions as the diffuser within the pressure increase space, to thereby surely improve the above-mentioned energy conversion efficiency.

However, as in the ejector of the earlier application example, the valve body that changes the refrigerant passage area within the decompression space and the refrigerant passage area within the pressure increase space at the same time may become larger in physique than, for example, a valve body that changes only the refrigerant passage area within the decompression space. Further, since a load of the refrigerant on the valve body becomes larger, a physique of the drive device for displacing the valve body also becomes larger, and the overall ejector may be upsized.

In view of the above circumstances, an objective of the present disclosure is to downsize an ejector configured to be capable of converting energy at a high efficiency regardless of a heat load of an ejector type refrigeration cycle.

According to an aspect of the present disclosure, an ejector is used for a refrigeration cycle device of a vapor compression type. The ejector includes a body part including a refrigerant inlet into which a refrigerant flows, a swirling space in which the refrigerant flowing from the refrigerant inlet swirls, a decompression space in which the refrigerant flowing out of the swirling space is decompressed, a suction passage that communicates with a refrigerant flow downstream side of the decompression space and is a space into which the refrigerant is drawn from an external, and a pressure increase space in which the refrigerant ejected from the decompression space is mixed with the refrigerant drawn from the suction passage. The ejector further includes a valve body that is disposed in the decompression space, a passage formation member that is disposed in the pressure increase space and defines a refrigerant passage having a refrigerant passage area gradually expanding toward a downstream side in the refrigerant flow in the pressure increase space, and a drive device that displaces the valve body. The decompression space has a minimum area part smallest in cross-sectional area in a refrigerant passage, and the drive device displaces the valve body to change the cross-sectional area of the minimum area part in the refrigerant passage. The refrigerant passage defined by an outer peripheral surface of the valve body functions as a nozzle that decompresses the refrigerant flowing out of the swirling space and ejects the refrigerant, and the refrigerant passage defined by an outer peripheral surface of the passage formation member functions as a diffuser that converts velocity energies of the ejected refrigerant and the drawn refrigerant into a pressure energy. The valve body and the passage formation member are provided as separated members.

According to the above configuration, since the refrigerant having the reduced pressure on the swirling center side within the swirling space flows into the decompression space, the energy conversion efficiency (corresponding to the nozzle efficiency) in the refrigerant passage that functions as the nozzle within the decompression space can be improved. In addition, since the drive device displaces the valve body according to the heat load of the refrigeration cycle device, the high energy conversion efficiency can be exhibited regardless of the heat load.

Further, since the valve body and the passage formation member are provided as separated members, the valve body can be downsized. Since the load attributable to the pressure received by the valve body from the refrigerant becomes also small due to a reduction in the size, the drive device for displacing the valve body can be downsized. As a result, the overall ejector can be downsized.

Also, each of the pressure increase space and the passage formation member may be formed into a rotating body shape, or may be shaped to expand gradually in a radial direction toward the refrigerant flow downstream side. According to this shape, since the refrigerant passage that functions as the diffuser within the pressure increase space expands radially outward from an axis center side, a dimension of the overall ejector in an axis direction can be reduced.

EMBODIMENTS FOR EXPLOITATION OF THE INVENTION

Figure 1:
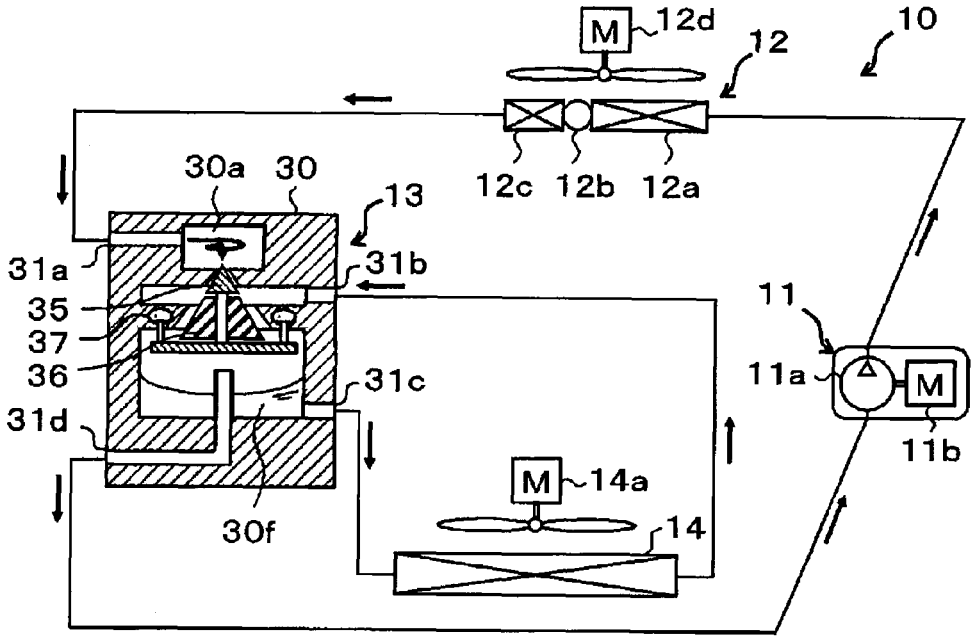
FIG. 1 is a schematic diagram of an ejector type refrigeration cycle according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described with reference to FIGS. 1 to 4. As illustrated in FIG. 1, an ejector 13 according to the present embodiment is applied to a refrigeration cycle device having an ejector as refrigerant decompressing means, that is, an ejector type refrigeration cycle 10. Moreover, the ejector type refrigeration cycle 10 is applied to a vehicle air conditioning system, and performs a function of cooling air which is blown into a vehicle interior that is a space to be air-conditioned.

First, in the ejector type refrigeration cycle 10, a compressor 11 sucks a refrigerant, raises a pressure until the refrigerant becomes a high-pressure refrigerant, and discharges the refrigerant. Specifically, the compressor 11 of the present embodiment is an electric compressor in which a fixed-capacity compression mechanism 11*a* and an electric motor 11*b* for driving the compression mechanism 11*a* are accommodated in one housing.

Various compression mechanisms, such as a scroll-type compression mechanism and a vane-type compression mechanism, can be employed as the compression mechanism 11*a*. Further, the operation (rotating speed) of the electric motor 11*b* is controlled by a control signal that is output from a control device to be described below, and any one of an AC motor and a DC motor may be employed as the electric motor 11*b*.

A refrigerant inlet side of a condensing part 12*a* of a heat radiator 12 is connected to a discharge port of the compressor 11. The heat radiator 12 is a heat exchanger for heat radiation that cools a high-pressure refrigerant, which is discharged from the compressor 11, through the radiation of heat by exchanging heat between the high-pressure refrigerant and vehicle exterior air (outside air) that is blown by a cooling fan 12*d*.

More specifically, the heat radiator 12 is a so-called subcooling condenser including: a condensing part 12*a* that condenses a high-pressure gas-phase refrigerant, which is discharged from the compressor 11, by exchanging heat between the high-pressure gas-phase refrigerant and the outside air, which is blown from the cooling fan 12*d*, to radiate the heat of the high-pressure gas-phase refrigerant; a receiver part 12*b* that separates gas and liquid of the refrigerant having flowed out of the condensing part 12*a* and stores a surplus liquid phase refrigerant; and a subcooling part 12*c* that subcools a liquid phase refrigerant having flowed out of the receiver part 12*b* by exchanging heat between the liquid phase refrigerant and the outside air blown from the cooling fan 12*d*.

Meanwhile, the ejector type refrigeration cycle 10 of the present embodiment employs an HFC based refrigerant (specifically, R134a) as the refrigerant, and forms a subcritical refrigeration cycle in which the pressure of a high-pressure side refrigerant does not exceed a critical pressure of the refrigerant. An HFO based refrigerant (specifically, R1234yf) or the like may be employed as the refrigerant forming the subcritical refrigeration cycle. Further, a refrigerant oil for lubricating the compressor 11 is mixed with the refrigerant, and a part of the refrigerant oil is circulated in the cycle together with the refrigerant.

The cooling fan 12*d* is an electric blower of which the rotating speed (the amount of blown air) is controlled by a control voltage output from the control device. A refrigerant inlet 31*a* of the ejector 13 is connected to a refrigerant outlet side of the subcooling part 12*c* of the heat radiator 12.

The ejector 13 functions as refrigerant decompressing means for decompressing the high pressure liquid-phase refrigerant of the subcooling state, which flows out from the heat radiator 12, and allowing the refrigerant to flow out to the downstream side, and also functions as refrigerant circulating means (refrigerant transport means) for sucking (transporting) the refrigerant flowing out from an evaporator 14 to be described later by the suction action of a refrigerant flow ejected at high speed to circulate the refrigerant. Further, the ejector 13 according to the present embodiment also functions as gas-liquid separation means for separating the decompressed refrigerant into gas and liquid.

A specific configuration of the ejector 13 will be described with reference to FIGS. 2 and 3A to 3C. Meanwhile, up and down arrows in FIG. 2 indicate, respectively, up and down directions in a state where the ejector type refrigeration cycle 10 is mounted on a vehicle air conditioning system. Also, FIG. 3A is a schematic cross-sectional diagram illustrating functions of the respective refrigerant passages of the ejector 13, and the same parts as those in FIG. 2 are denoted by identical symbols.

Figure 2:
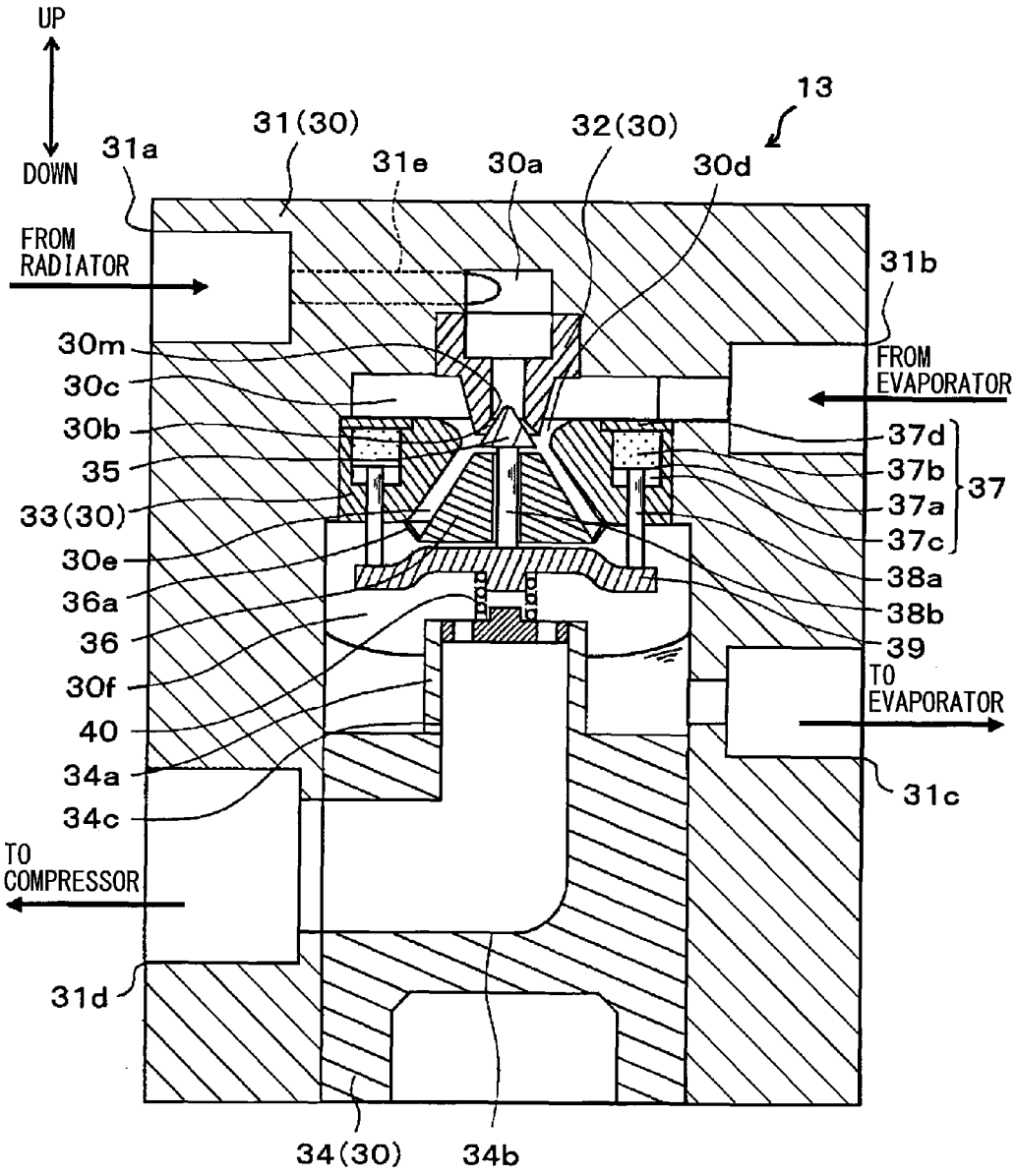
FIG. 2 is a cross-sectional diagram along an axis direction of an ejector according to the first embodiment.
Figure 3A:
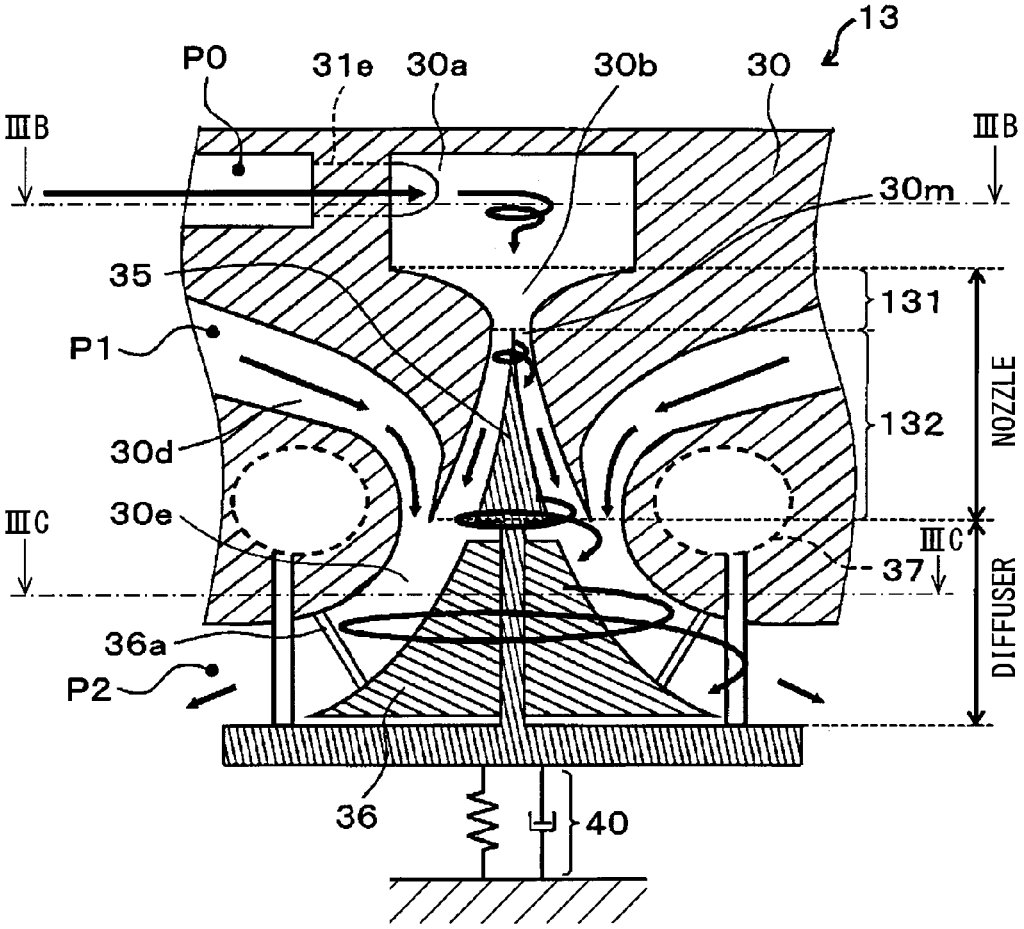
FIG. 3A is a schematic cross-sectional view illustrating flows of the refrigerant in respective refrigerant passages of the ejector according to the first embodiment.

First, as illustrated in FIG. 2, the ejector 13 according to the present embodiment includes a body part 30 configured by the combination of plural components. Specifically, the body part 30 has a housing body 31 made of prismatic-cylindrical or circular-cylindrical metal, and forming an outer shell of the ejector 13. A nozzle body 32, a middle body 33, and a lower body 34 are fixed to an interior of the housing body 31.

The housing body 31 is formed with a refrigerant inlet 31*a* through which the refrigerant that has flowed out of the heat radiator 12 flows into the housing body 31, and a refrigerant suction port 31*b* through which the refrigerant that has flowed out of the evaporator 14 is sucked into the housing body 31. The housing body 31 is also formed with a liquid-phase refrigerant outlet 31*c* through which a liquid-phase refrigerant separated by a gas-liquid separation space 30*f* formed within the body part 30 flows out to the refrigerant inlet side of the evaporator 14, and a gas-phase refrigerant outlet 31*d* through which the gas-phase refrigerant separated by the gas-liquid separation space 30*f* flows out to the suction side of the compressor 11.

The nozzle body 32 is formed of a substantially conically-shaped metal member that is tapered in a refrigerant flow direction. The nozzle body 32 is fixed to the interior of the housing body 31 by means such as press fitting so that an axial direction of the nozzle body 32 is parallel to a vertical direction (up-down direction in FIG. 2). A swirling space 30*a* in which the refrigerant that has inflows from the refrigerant inlet 31*a* is swirled is provided between an upper side of the nozzle body 32 and the housing body 31.

The swirling space 30*a* is formed into a rotating body shape, and a center axis of the swirling space 30*a* extends in the vertical direction. Meanwhile, the rotating body shape is a solid shape formed by rotating a plane figure around one straight line (center axis) coplanar with the plane figure. More specifically, the swirling space 30*a* of the present embodiment is formed into a substantially cylindrical shape. The swirling space 30*a* may be formed in a shape in which a circular cone or a circular truncated cone is combined with a cylinder, or the like.

Figure 3B:
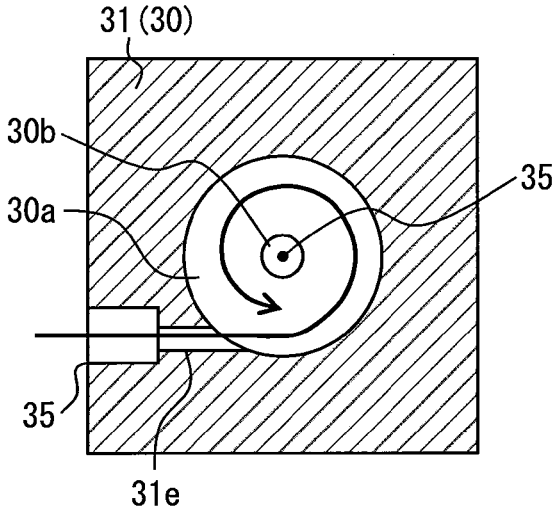
FIG. 3B is a cross-sectional view taken along a line IIIB-IIIB of FIG. 3A.

Further, as illustrated in FIG. 3B, the refrigerant inlet passage 31*e* that connects the refrigerant inlet 31*a* and the swirling space 30*a* extends in a tangential direction of an inner wall surface of the swirling space 30*a* when viewed in a center axis direction of the swirling space 30*a*. With this configuration, the refrigerant that has flowed into the swirling space 30*a* from the refrigerant inlet passage 31*e* flows along an inner wall surface of the swirling space 30*a*, and swirls within the swirling space 30*a*.

Meanwhile, the refrigerant inlet passage 31*e* does not need to be formed to completely match the tangential direction of the swirling space 30*a* when viewed in the center axis direction of the swirling space 30*a*. If the refrigerant inlet passage 31*e* includes at least a component in the tangential direction of the swirling space 30*a*, the refrigerant inlet passage 31*e* may be formed to include components in the other directions (for example, components in the axial direction of the swirling space 30*a*).

Here, since a centrifugal force acts on the refrigerant swirling in the swirling space 30*a*, the pressure of a refrigerant present on the center axis side becomes lower than the pressure of a refrigerant present on the outer peripheral side in the swirling space 30*a*. Accordingly, in the present embodiment, during the normal operation of the ejector type refrigeration cycle 10, the pressure of a refrigerant present on the center axis side in the swirling space 30*a* is lowered to a pressure at which a liquid phase refrigerant is saturated or a pressure at which a refrigerant is decompressed and boiled (cavitation occurs).

The adjustment of the pressure of a refrigerant present on the center axis side in the swirling space 30*a* can be realized by adjusting the swirling flow rate of the refrigerant swirling in the swirling space 30*a*. Further, the adjustment the swirling flow rate can be conducted by, for example, adjusting an area ratio between the passage sectional area of the refrigerant inlet passage 31*e* and the sectional area of the swirling space 30*a* perpendicular to the axial direction. Meanwhile, the swirling flow rate in the present embodiment means the flow rate of the refrigerant in the swirling direction in the vicinity of the outermost peripheral portion of the swirling space 30*a*.

A decompression space 30*b* that allows the refrigerant flowing out from the swirling space 30*a* to be decompressed, and flow out to the downstream side is formed within the nozzle body 32. The decompression space 30*b* is formed into a rotating body shape having a cylindrical space coupled with a circular truncated conical space that gradually expands in a refrigerant flow direction continuously from a lower side of the cylindrical space. A center axis of the decompression space 30*b* is arranged coaxially with the center axis of the swirling space 30*a*.

Further, a minimum area part 30*m* that is most reduced in the refrigerant passage area within the decompression space 30*b* is formed, and a valve body 35 that changes the passage area of the minimum area part 30*m* is arranged, within the decompression space 30*b*. The valve body 35 is formed into a substantially conical shape gradually widened toward the downstream side of the refrigerant flow, and the center axis of the valve body 35 is arranged coaxially with the center axis of the decompression space 30*b*.

The refrigerant passage formed between an inner peripheral surface of the decompression space 30*b* (an inner peripheral surface of a portion of the nozzle body 32 which defines the decompression space 30*b*), and an outer peripheral surface of the valve body 35, as illustrated in FIG. 3A, is configured by a convergent part 131 and a divergent part 132. The convergent part 131 extends to the minimum area part 30*m* toward a refrigerant flow downstream side, and has a refrigerant passage area gradually reduced, and the divergent part 132 extends toward the downstream side from the minimum area part 30*m*, and has a refrigerant passage area gradually enlarged.

In the divergent part 132, since the decompression space 30*b* overlaps (overlaps) with the valve body 35 when viewed from the radial direction, a sectional shape of the refrigerant passage perpendicular to the axis direction is annular (doughnut shape obtained by removing a smaller-diameter circular shape arranged coaxially from the circular shape). Further, since a spread angle of the valve body 35 of the present embodiment is smaller than a spread angle of the circular truncated conical space of the decompression space 30*b*, the refrigerant passage area of the divergent part 132 gradually enlarges toward the downstream side in the refrigerant flow.

In the present embodiment, the above passage shape allows the refrigerant passage formed between the inner peripheral surface of the decompression space 30*b* and the outer peripheral surface of the valve body 35 to function as the nozzle, and a flow rate of the refrigerant decompressed by the refrigerant passage increases to come close to the sound velocity. Further, in the nozzle passage, as schematically illustrated in FIG. 3A, the refrigerant flows along the refrigerant passage annular in cross-section while swirling.

Subsequently, as illustrated in FIG. 2, the middle body 33 is formed of a disc-shaped member made of metal having a through-hole of a rotating body shape which penetrates through both sides thereof in the center portion. The middle body 33 accommodates a drive device 37 that displaces the valve body 35 on an outer peripheral side of the through-hole. Meanwhile, a center axis of the through-hole is arranged coaxially with the center axes of the swirling space 30*a* and the decompression space 30*b*. Also, the middle body 33 is fixed to the interior of the housing body 31 and the lower side of the nozzle body 32 by means such as press fitting.

Further, an inflow space 30*c* is formed between an upper surface of the middle body 33 and an inner wall surface of the housing body 31 facing the middle body 33, and the inflow space 30*c* accumulates the refrigerant that has flowed out of a refrigerant suction port 31*b*. Meanwhile, in the present embodiment, because a tapered tip of a lower side of the nozzle body 32 is located within the through-hole of the middle body 33, the inflow space 30*c* is formed into an annular shape in cross-section when viewed in the center axis direction of the swirling space 30*a* and the decompression space 30*b*.

The through-hole of the middle body 33 has a part in which a refrigerant passage sectional area is gradually reduced toward the refrigerant flow direction so as to match an outer peripheral shape of the tapered tip of the nozzle body 32 in an area where the lower side of the nozzle body 32 is inserted, that is, an area the middle body 33 and the nozzle body 32 overlap with each other when viewed in a radial direction.

Accordingly, a suction passage 30*d* that sucks the refrigerant from the refrigerant suction port 31*b* is formed between an inner peripheral surface of the through-hole and an outer peripheral surface of the lower side of the nozzle body 32, and the inflow space 30*c* communicates with a downstream side of the decompression space 30*b* in the refrigerant flow through the suction passage 30*d*. Meanwhile, the suction passage 30*d* is also formed into an annular shape in a cross-section when viewed from the center axis direction.

Also, a pressure increase space 30*e* formed into a substantially circular truncated conical shape that is gradually widened in the refrigerant flow direction is formed in the through-hole of the middle body 33 on the downstream side of the suction passage 30*d* in the refrigerant flow. The pressure increase space 30*e* is a space in which the ejected refrigerant ejected from the above-mentioned refrigerant passage that functions as the nozzle is mixed with the sucked refrigerant sucked from the suction passage 30*d*.

Figure 3C:
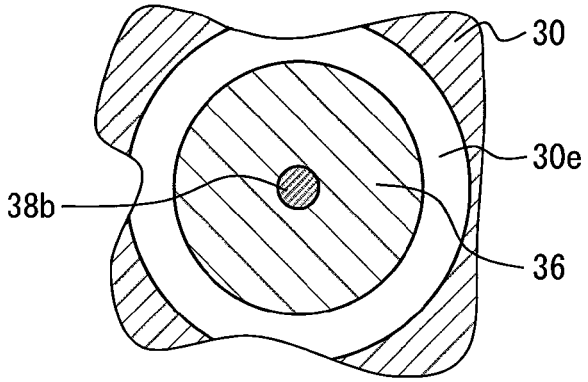
FIG. 3C is a cross-sectional view taken along a line IIIC-IIIC of FIG. 3A.

A passage formation member 36 is arranged within the pressure increase space 30*e*, and the passage formation member 36 forms the refrigerant passage having a passage area gradually enlarged toward the refrigerant flow downstream side within the pressure increase space 30*e*. In more detail, the passage formation member 36 is formed of a member different from the valve body 35, and formed into a rotating body shape (substantially truncated cone shape) that gradually widens toward the downstream side in the refrigerant flow. As illustrated in FIG. 3C, the center axis of the passage formation member 36 is arranged coaxially with the center axis of the pressure increase space 30*e*. The center axis of the passage formation member 36 is arranged coaxially with the center axis of a center side actuating bar 38*b* fixed to the valve body 35. Also, a given gap is provided between the valve body 35 and the passage formation member 36 in the axis direction of the valve body 35 and the passage formation member 36.

Further, the spread angle of the passage formation member 36 according to the present embodiment is smaller than the spread angle of the truncated conical space of the pressure increase space 30*e*. Therefore, the refrigerant passage formed between an inner peripheral surface of the pressure increase space 30*e* (an inner peripheral surface of a portion forming the pressure increase space 30*e* of the middle body 33) and an outer peripheral surface of the passage formation member 36 is formed into an annular shape in a cross-section when viewed from the center axis direction, and the refrigerant passage area of the refrigerant passage gradually enlarges toward the downstream side in the refrigerant flow.

In the present embodiment, the refrigerant passage area is enlarged as described above. Thus, as illustrated in FIG. 3A, the refrigerant passage, which is formed between the inner peripheral surface of the pressure increase space 30*e* and the outer peripheral surface of the passage formation member 36, functions as a diffuser. The diffuser converts velocity energies of the ejected refrigerant and the sucked refrigerant into a pressure energy.

Further, in the refrigerant passage that functions as the diffuser formed between the inner peripheral surface of the pressure increase space 30*e* and the outer peripheral surface of the passage formation member 36, the refrigerant flows while swirling along the refrigerant passage having the annular shape in a cross-section by a velocity component in the swirling direction provided in the ejected refrigerant ejected from the refrigerant passage functioning as the nozzle formed between the inner peripheral surface of the decompression space 30*b* and the outer peripheral surface of the valve body 35.

Also, as illustrated in FIG. 2, the passage formation member 36 has plural legs 36*a*, and is fixed to the body part 30 (specifically, a bottom side of the middle body 33) by the legs 36*a*. Therefore, the refrigerant passage in which the refrigerant flows is formed between the respective legs 36*a*.

Subsequently, the drive device 37 that is arranged on the outer peripheral side of the middle body 33 and displaces the valve body 35 will be described. The drive device 37 is configured with a circular thin plate diaphragm 37*a* which is a pressure responsive member. More specifically, as illustrated in FIG. 2, the diaphragm 37*a* is fixed by means such as welding so as to partition a cylindrical space formed on the outer peripheral side of the middle body 33 into two upper and lower spaces.

The upper space (the inflow space 30*c* side) of the two spaces partitioned by the diaphragm 37*a* configures a sealed space 37*b* in which a temperature sensitive medium is enclosed. A pressure of the temperature sensitive medium changes according to a temperature of the refrigerant flowing out of the evaporator 14. The temperature sensitive medium, which has the same composition as that of a refrigerant circulating in the refrigeration cycle 10, is enclosed in the sealed space 37*b* so as to have a predetermined density. Accordingly, the temperature sensitive medium of the present embodiment is R134a.

On the other hand, the lower space of the two spaces partitioned by the diaphragm 37*a* configures an introduction space 37*c* into which the refrigerant flowing out of the evaporator 14 is introduced through a non-shown communication channel. Therefore, the temperature of the refrigerant flowing out of the evaporator 14 is transmitted to the temperature sensitive medium enclosed in the sealed space 37*b* via a cap member 37*d* and the diaphragm 37*a*. The cap member 37*d* partitions the inflow space 30*c* and the sealed space 37*b*.

As a result, an internal pressure of the sealed space 37*b* becomes a pressure corresponding to the temperature of the refrigerant flowing out of the evaporator 14. Further, the diaphragm 37*a* is deformed according to a differential pressure between the internal pressure of the sealed space 37*b* and the pressure of the refrigerant which has flowed into the introduction space 37*c* from the evaporator 14. For that reason, it is preferable that the diaphragm 37*a* is made of a material rich in elasticity, excellent in heat conduction, and tough. For example, it is desirable that the diaphragm 37*a* is formed of a metal laminate made of stainless steel (SUS304).

Also, an upper end side of a columnar outer peripheral side actuating bar 38*a* is joined to a center portion of the diaphragm 37*a* by means such as welding, and a plate member 39 is fixed to a lower end side of the outer peripheral side actuating bar 38*a*. Further, a lower end side of a columnar center side actuating bar 38*b* is fixed to a center portion of the plate member 39, and a bottom side of the valve body 35 is fixed to an upper end side of the center side actuating bar 38*b*.

With this configuration, the diaphragm 37*a* and the valve body 35 are coupled with each other, and the valve body 35 is displaced in accordance with a displacement of the diaphragm 37*a* to regulate the refrigerant passage area of the minimum area part 30*m* in the decompression space 30*b*.

Specifically, when the temperature (the degree of superheat) of the refrigerant following out of the evaporator 14 rises, a saturated pressure of the temperature sensitive medium enclosed in the sealed space 37*b* rises to increase a differential pressure obtained by subtracting the pressure of the introduction space 37*c* from the internal pressure of the sealed space 37*b*. Accordingly, the diaphragm 37*a* displaces the valve body 35 in a direction of enlarging the refrigerant passage area in the minimum area part 30*m* (toward the lower side in the vertical direction).

On the other hand, when the temperature (the degree of superheat) of the refrigerant flowing out of the evaporator 14 falls, a saturated pressure of the temperature sensitive medium sealed in the sealed space 37*b* falls to decrease the differential pressure obtained by subtracting the pressure of the introduction space 37*c* from the internal pressure of the sealed space 37*b*. Accordingly, the diaphragm 37*a* displaces the valve body 35 in a direction of reducing the refrigerant passage area of the minimum area part 30*m* (toward the upper side in the vertical direction).

Since the diaphragm 37*a* displaces the valve body 35 according to the degree of superheating of the refrigerant flowing out of the evaporator 14 as described above, the refrigerant passage area of the minimum area part 30*m* is adjusted so that the degree of superheating of the refrigerant present on the outlet side of the evaporator 14 comes closer to a predetermined given value.

The plate member 39 is subjected to a load of a coil spring 40 fixed to the lower body 34. The coil spring 40 exerts the load urging the plate member 39 so that the valve body 35 reduces the refrigerant passage area in the minimum area part 30*m* of the decompression space 30*b*. With the regulation of this load, a valve opening pressure of the valve body 35 can be changed to change a target degree of superheat.

Further, an outer diameter of the plate member 39 is formed larger than a maximum outer diameter of the above-mentioned passage formation member 36. Therefore, the outer peripheral side actuating bar 38*a* does not contact with the passage formation member 36. Also, a gap between the outer peripheral side actuating bar 38*a* and the middle body 33 is sealed by a seal member such as an O-ring not shown, and the refrigerant is not leaked through the gap even if the outer peripheral side actuating bar 38*a* is displaced.

Next, the lower body 34 is formed of a circular-cylindrical metal member, and fixed in the housing body 31 by means such as screwing so as to close a bottom of the housing body 31. The gas-liquid separation space 30*f* that separates gas and liquid of the refrigerant that has flowed out of the above-mentioned refrigerant passage that functions as the diffuser is provided between the upper side of the lower body 34 and the middle body 33.

The gas-liquid separation space 30*f* is formed as a space of a substantially cylindrical rotating body shape, and the center axis of the gas-liquid separation space 30*f* is also arranged coaxially with the center axes of the swirling space 30*a* and the decompression space 30*b*.

Also, as described above, in the refrigerant passage that functions as the diffuser formed between the inner peripheral surface of the pressure increase space 30*e* and the outer peripheral surface of the passage formation member 36, the refrigerant flows while swirling along the refrigerant passage annular in a cross-section. Therefore, the refrigerant that flows into the gas-liquid separation space 30*f* from the refrigeration passage functioning as the diffuser also has a velocity component in a swirling direction. Therefore, the gas and liquid of the refrigerant are separated by the action of the centrifugal force within the gas-liquid separation space 30*f*.

A cylindrical pipe 34*a* that is arranged coaxially with the gas-liquid separation space 30*f* and extends upward is disposed in the center portion of the lower body 34. The liquid-phase refrigerant separated in the gas-liquid separation space 30*f* is accumulated on a radially outer side of the pipe 34*a*. Also, a gas-phase refrigerant outflow passage 34*b* is formed inside the pipe 34*a* and guides the gas-phase refrigerant separated in the gas-liquid separation space 30*f* to the gas-liquid refrigerant outlet 31*d* of the housing body 31.

Further, the above-mentioned coil spring 40 is fixed to an upper end of the pipe 34*a*. The coil spring 40 also functions as a vibration absorbing member that attenuates the vibration of the valve body 35, which is caused by a pressure pulsation generated when the refrigerant is decompressed. Additionally, an oil return hole 34*c* that returns a refrigerant oil in the liquid-phase refrigerant into the compressor 11 through the gas-phase refrigerant outflow passage 34*b* is formed on a base portion (lowermost portion) of the pipe 34*a*.

The liquid-phase refrigerant outlet 31*c* of the ejector 13 is connected with an inlet side of the evaporator 14 as illustrated in FIG. 1. The evaporator 14 is a heat exchanger for absorbing heat that evaporates a low-pressure refrigerant decompressed by the ejector 13 and performs a heat absorbing action by exchanging heat between the low-pressure refrigerant and air that is blown into the vehicle interior from a blower fan 14*a*.

The blower fan 14*a* is an electric blower of which the rotation speed (the amount of blown air) is controlled by a control voltage output from the control device. An outlet side of the evaporator 14 is connected with the refrigerant suction port 31*b* of the ejector 13. Further, the gas-phase refrigerant outlet 31*d* of the ejector 13 is connected with the suction side of the compressor 11.

Next, the control device (not shown) includes a well-known microcomputer including a CPU, a ROM and a RAM, and peripheral circuits of the microcomputer. The control device controls the operations of the above-mentioned various electric actuators 11*b*, 12*d*, and 14*a* and the like by performing various calculations and processing on the basis of a control program stored on the ROM.

Further, a sensor group for controlling air conditioning, such as an inside air-temperature sensor for detecting the temperature of air present in the vehicle interior, an outside air-temperature sensor for detecting the temperature of outside air, a solar radiation sensor for detecting the quantity of solar radiation in the vehicle interior, an evaporator-temperature sensor for detecting the temperature of air discharged from the evaporator 14 (the temperature of the evaporator), an outlet-side temperature sensor for detecting the temperature of a refrigerant on the outlet side of the heat radiator 12, and an outlet-side pressure sensor for detecting the pressure of a refrigerant present on the outlet side of the heat radiator 12, is connected to the control device. Accordingly, detection values of the sensor group are input to the control device.

Furthermore, an operation panel (not shown), which is disposed near a dashboard positioned at the front portion in the vehicle interior, is connected to the input side of the control device, and operation signals output from various operation switches mounted on the operation panel are input to the control device. An air conditioning operation switch that is used to perform air conditioning in the vehicle interior, a vehicle interior temperature setting switch that is used to set the temperature of air present in the vehicle interior, a switch that is used to select an air conditioning operation mode, and the like are provided as the various operation switches that are mounted on the operation panel.

Meanwhile, the control device of the present embodiment is integrated with control means for controlling the operations of various control target devices connected to the output side of the control device, but structure (hardware and software), which controls the operations of the respective control target devices, of the control device forms control means of the respective control target devices. For example, structure (hardware and software), which controls the operation of the electric motor 11*b* of the compressor 11, forms discharge capability control means in the present embodiment.

Next, the operation of the present embodiment having the above-mentioned configuration will be described with reference to a Mollier diagram of FIG. 4. The axis of ordinate in the Mollier diagram represents a pressure corresponding to P0, P1, and P2 in FIG. 3A. First, when an operation switch of the operation panel is turned on, the control device operates the electric motor 11*b* of the compressor 11, the cooling fan 12*d*, and the blower fan 14*a*, and the like. Accordingly, the compressor 11 sucks and compresses a refrigerant and discharges the refrigerant.

The gas-phase refrigerant (point a4 in FIG. 4), which is discharged from the compressor 11 and has a high temperature and a high pressure, flows into the condensing part 12*a* of the heat radiator 12 and is condensed by exchanging heat between the air (outside air), which is blown from the cooling fan 12*d*, and itself and by radiating heat. The refrigerant, which has radiated heat in the condensing part 12*a*, is separated into gas and liquid in the receiver part 12*b*. A liquid phase refrigerant, which has been subjected to gas-liquid separation in the receiver part 12*b*, is changed into a subcooled liquid phase refrigerant by exchanging heat between the air, which is blown from the cooling fan 12*d*, and itself in the subcooling part 12*c* and further radiating heat (from point a4 to point b4 in FIG. 4).

Figure 4:
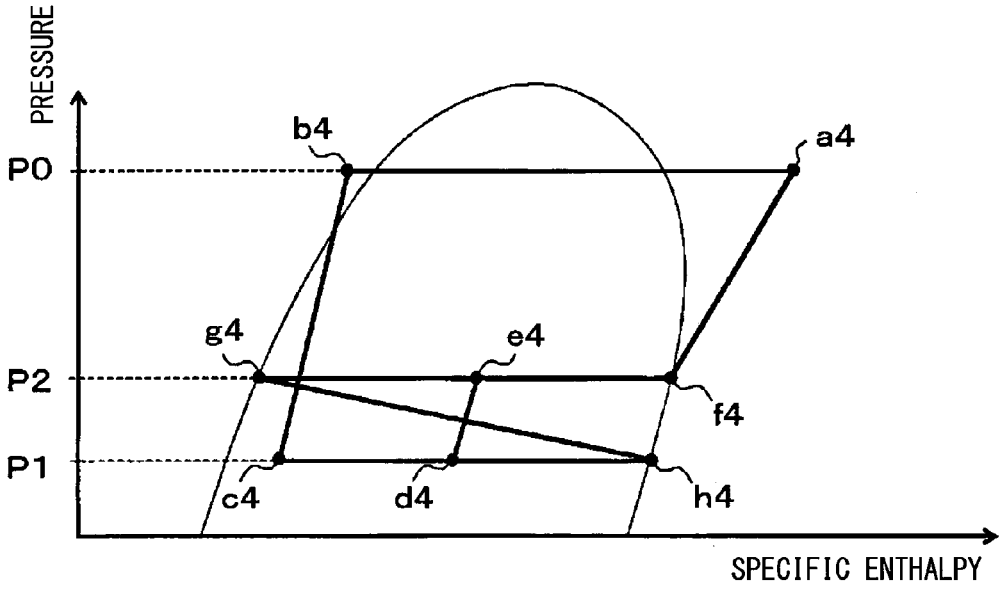
FIG. 4 is a Mollier diagram illustrating a state of the refrigerant in the ejector type refrigeration cycle according to the first embodiment.

The subcooled liquid phase refrigerant that has flowed out of the subcooling part 12*c* of the heat radiator 12 is isoentropically decompressed by the refrigerant passage, and ejected (from point b4 to point c4 in FIG. 4). The refrigerant passage functions as the nozzle formed between the inner peripheral surface of the decompression space 30*b* of the ejector 13 and the outer peripheral surface of the valve body 35. In this situation, the refrigerant passage area in the minimum area part 30*m* of the decompression space 30*b* is regulated so that the degree of superheating of the refrigerant on the outlet side of the evaporator 14 comes close to a predetermined given value.

The refrigerant that has flowed out of the evaporator 14 is sucked through the refrigerant suction port 31*b*, the inflow space 30*c*, and the suction passage 30*d*, by the suction action of the ejected refrigerant ejected from the refrigerant passage which functions as the nozzle. Further, the ejected refrigerant ejected from the refrigerant passage that functions as the nozzle and the suction refrigerant sucked through the suction passage 30*d* flow into the refrigerant passage that functions as the diffuser formed between the inner peripheral surface of the pressure increase space 30*e* and the outer peripheral surface of the passage formation member 36 (from point c4 to point d4, and from point h4 to point d4 in FIG. 4).

In the refrigerant passage that functions as the diffuser, the velocity energy of the refrigerant is converted into the pressure energy due to the enlarged refrigerant passage area. As a result, the pressure of the mixed refrigerant rises while the ejected refrigerant and the sucked refrigerant are mixed together (from point d4 to point e4 in FIG. 4). The refrigerant that flowed out of the refrigerant passage that functions as the diffuser is separated into gas and liquid in the gas-liquid separation space 30*f* (from point e4 to point f4, and from point e4 to point g4 in FIG. 4).

The liquid-phase refrigerant that has been separated in the gas-liquid separation space 30*f* flows out of the liquid-phase refrigerant outlet 31*c*, and flows into the evaporator 14. The refrigerant having flowed into the evaporator 14 absorbs heat from the air blown by the blowing fan 14*a*, and evaporates, and the blown air is cooled (point g4 to point h4 in FIG. 4). On the other hand, the gas-phase refrigerant that has been separated in the gas-liquid separation space 30*f* flows out of the gas-phase refrigerant outlet 31*d*, and flows into the compressor 11.

The ejector type refrigeration cycle 10 according to the present embodiment operates as described above, and can cool the air to be blown into the vehicle interior. Further, in the ejector type refrigeration cycle 10, since the refrigerant boosted by the refrigerant passage that functions as the diffuser of the ejector 13 is sucked into the compressor 11, the drive power of the compressor 11 can be reduced to improve the cycle of performance (COP).

Further, according to the ejector 13 of the present embodiment, the refrigerant swirls within the swirling space 30*a*, and the refrigerant having the reduced pressure on the swirling center side flows into the decompression space 30*b*. Therefore, the refrigerant can be surely decompressed and boiled in the vicinity of the minimum area part 30*m*. With the above configuration, the energy conversion efficiency (corresponding to the nozzle efficiency) in the refrigerant passage that functions as the nozzle can be improved.

In addition, the drive device 37 displaces the valve body 35 so that the degree of superheating of the refrigerant on the outlet side of the evaporator 14 comes closer to a predetermined given value, thereby being capable of appropriately regulating the refrigerant passage area of the minimum area part 30*m* according to the heat load of the ejector type refrigeration cycle 10. Therefore, the ejector 13 according to the present embodiment can exhibit the high energy conversion efficiency regardless of the heat load of the ejector type refrigeration cycle 10.

Further, in the ejector 13 according to the present embodiment, since the valve body 35 and the passage formation member 36 are provided as separated members, the valve body 35 can be downsized compared with a case in which the valve body 35 and the passage formation member 36 are formed of one member. Since the load attributable to the pressure received by the valve body 35 from the refrigerant becomes also small due to a reduction in the size, the drive device 37 for displacing the valve body 35 can be downsized. As a result, the overall ejector 13 can be downsized.

The ejector 13 according to the embodiment, each of the pressure increase space 30*e* and the passage formation member 36 is formed into a rotating body shape, or truncated cone is shaped to expand gradually radially toward the refrigerant flow downstream side. As a result, since the refrigerant passage that functions as the diffuser can be formed to expand radially outward from the axis center side, the axial dimension can be reduced, and further downsized as the overall ejector 13.

Also, in the ejector 13 according to the present embodiment, the gas-liquid separation space 30*f* is formed on the refrigerant flow downstream side (lower side in the vertical direction) of the refrigerant passage that functions as the diffuser. Hence, the volume of the gas-liquid separation space 30*f* can be effectively reduced as compared with a case in which gas-liquid separating means is provided in addition to the ejector 13.

That is, in the gas-liquid separation space 30*f* according to the present embodiment, since the refrigerant that flows out of the refrigerant passage functioning as the diffuser having the annular shape in the cross-section has been already swirled, there is no need to provide a space for generating or growing the swirling flow of the refrigerant in the gas-liquid separation space 30*f*. Therefore, the volume of the gas-liquid separation space 30*f* can be effectively reduced as compared with the case in which the gas-liquid separating means is provided apart from the ejector 13.

Also, in the ejector 13 according to the present embodiment, since the passage formation member 36 is fixed to the body part 30 by the plural legs 36*a*, even if the passage formation member 36 is formed of a material different from the valve body 35, the passage formation member 36 can be surely and easily fixed to the internal space of the body part 30 in the ejector 13.

Also, in the ejector 13 according to the present embodiment, since the suction passage 30*d* is formed into the annular shape in the cross-section when viewed from the center axis direction, the refrigerant flowing out of the evaporator 14 can be sucked from an overall peripheral surface of the tapered tip of the lower end side of the nozzle body 32. As a result, the suction pressure loss when sucking the refrigerant flowing out of the evaporator 14 can be suppressed, and the cycle of performance (COP) of the ejector type refrigeration cycle 10 can be further improved.

Also, in the ejector 13 according to the present embodiment, the sealing space 37*b* configuring the drive device 37 is arranged on the lower side of the inflow space 30*c*, and the temperature of the refrigerant within the inflow space 30*c* can be transmitted to the temperature sensitive medium (refrigerant) within the sealing space 37*b*. As a result, the refrigerant flowing out of the evaporator 14 can be transmitted to the temperature sensitive medium within the sealing space 37*b* from both of the inflow space 30*c* side and the introduction space 37*c* side.

Therefore, the internal pressure of the sealing space 37*b* can be inhibited from changing by an influence of the outside air temperature, and the refrigerant passage area of the minimum area part 30*m* can be precision regulated according to the temperature (the degree of superheating) of the refrigerant flowing out of the evaporator 14.

Second Embodiment

Figure 5:
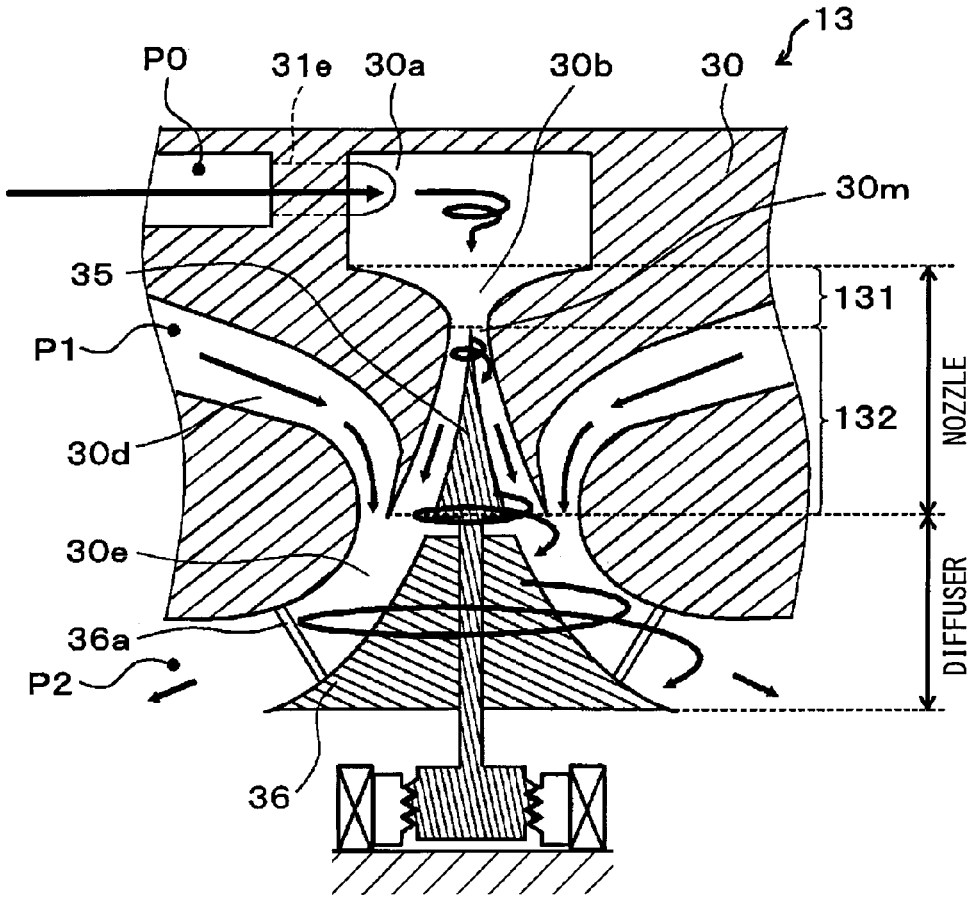
FIG. 5 is a schematic cross-sectional diagram of an ejector according to a second embodiment of the present disclosure.

In the first embodiment, the drive device 37 that displaces the valve body 35 is formed of the diaphragm 37*a* which is a pressure responsive member. However, in the present embodiment, as illustrated in FIG. 5, an electric drive device formed of a stepping motor 41 coupled to the valve body 35 is applied. Meanwhile, the operation of the stepping motor 41 is controlled by a control pulse that is output from the control device.

Also, the control device according to the present embodiment is connected with detecting means for detecting the temperature and the pressure of the refrigerant on the outlet side of the evaporator 14. The control device calculates the degree of superheating of the refrigerant on the outlet side of the evaporator 14 on the basis of a detection signal from those detecting means, and controls the operation of the stepping motor 41 so that the calculated degree of superheating comes closer to a predetermined target degree of superheating. Other structures and operations are the same as those of the first embodiment.

Therefore, as in the first embodiment, the ejector 13 according to the present embodiment can exhibit the high energy conversion efficiency regardless of the heat load of the ejector refrigeration cycle 10. Further, since the downsized stepping motor 41 can be employed, the overall ejector 13 can be downsized.

Meanwhile, when the electric drive device is employed as in the present embodiment, detecting means for detecting the temperature and the pressure of the refrigerant on the outlet side of the heat radiator 12 is provided, and the control device calculates the degree of subcooling of the refrigerant on the outlet side of the heat radiator 12 on the basis of a detection signal from those detecting means, and controls the operation of the stepping motor 41 so that the calculated degree of subcooling comes closer to a predetermined target degree of subcooling.

Third Embodiment

Figure 6:
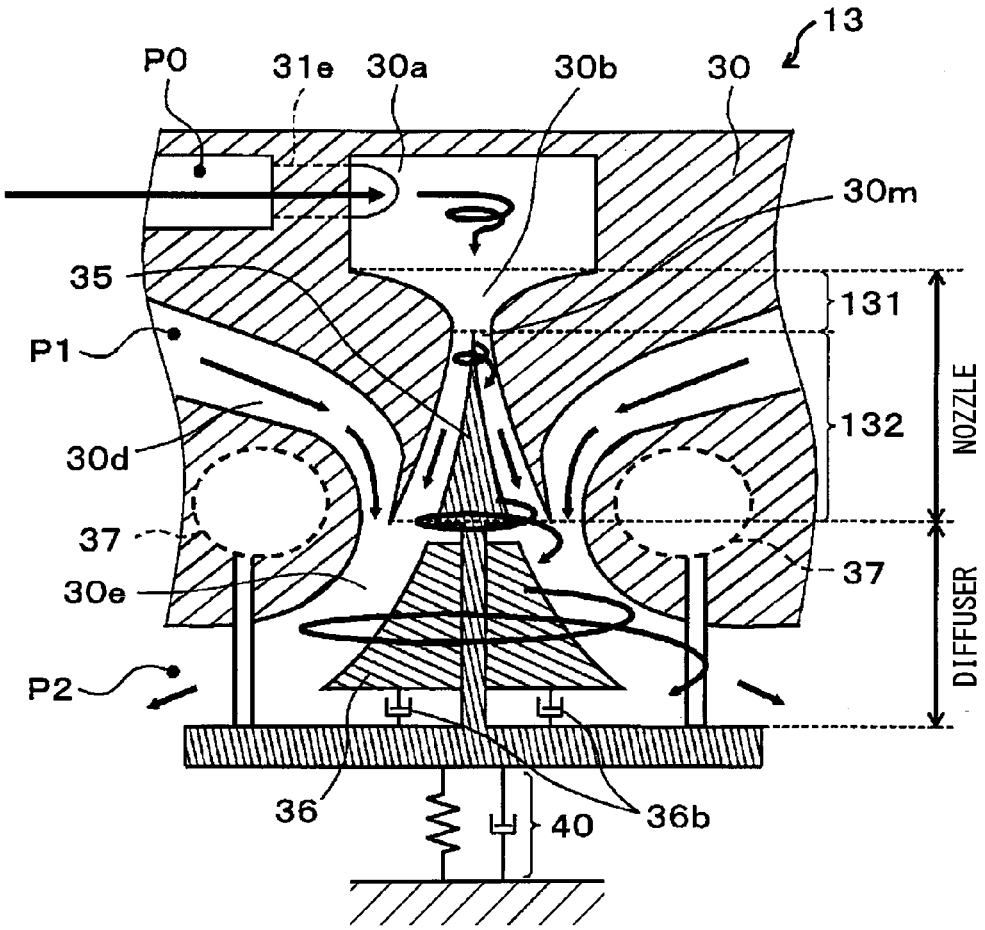
FIG. 6 is a schematic cross-sectional diagram of an ejector according to a third embodiment of the present disclosure.

In the present embodiment, as illustrated in FIG. 6, the legs 36*a* are scraped, the passage formation member 36 and the valve body 35 (specifically, the plate member 39) are coupled with each other through the vibration buffering member 36*b*. As the vibration buffering member 36*b*, elastic members such as a coil spring or a resin material that can inhibit the vibration of the passage formation member 36 from being transmitted to the valve body 35 through the plate member 39 and the center side actuating bar 38*b* can be employed.

With the provision of the vibration buffering member 36*b* as described above, the load attributable to the pressure received by the passage formation member 36 from the refrigerant is inhibited from being transmitted to the valve body 35 through the plate member 39. Therefore, the drive device 37 substantially displaces only the valve body 35. Therefore, even if the passage formation member 36 is coupled with the valve body 35 through the vibration buffering member 36*b*, the ejector 13 can be downsized as in the first embodiment.

Other Embodiments

This disclosure is not limited to the above-mentioned embodiments, and may have various modifications as described below without departing from the gist of this disclosure. Means disclosed in the respective embodiments may be appropriately combined together in an implementable range.

(1) In the above first and second embodiments, an example in which the passage formation member 36 is fixed to the bottom side of the middle body 33 by the plural legs 36*a* has been described. However, a fixing configuration of the passage formation member 36 by the legs 36*a* is not limited to this example. For example, the passage formation member 36 may be fixed to the housing body 31 by legs extending in the radial direction. Further, when the plural legs 36*a* are provided, it is desirable that the legs 36*a* are arranged at regular angular intervals with respect to the respective center axes.

(2) In the above first and third embodiments, an example in which the plural columnar spaces are provided on the outer peripheral side of the middle body 33, and the circular thin plate diaphragm 37*a* is fixed to the interior of the space to configure the drive device 37 has been described. Similarly, when the plural drive devices 37 are provided, it is desirable that the drive devices 37 are arranged at regular angular intervals with respect to the respective center axes. Further, the diaphragm 37*a* formed of an annular thin plate may be fixed within a space formed into an annular shape when viewed from the axial direction to configure the drive device.

(3) In the above embodiments, the details of the liquid-phase refrigerant outlet 31*c* and the gas-phase refrigerant outlet 31*d* of the ejector 13 are not described. Decompressing means (for example, a side fixed aperture orifice or a capillary tube) for decompressing the refrigerant may be arranged on those refrigerant outlets. For example, a fixed aperture may be added to the liquid-phase refrigerant outlet 31*c*, and the ejector 13 may be applied to an ejector type refrigeration cycle of a two-stage boost type having a high state side compression mechanism and a lower stage side compression mechanism.

(4) In the above embodiment, the ejector 13 in which the gas-liquid separation space 30*f* is formed within the body part 30 is described. However, the gas-liquid separation space 30*f* may be scraped. In this case, the gas-liquid separating means separated from the ejector 13 may be provided.

(5) In the above embodiments, an example in which the ejector type refrigeration cycle 10 including the ejector 13 of the present disclosure is applied to a vehicle air conditioning system has been described, but the application of the ejector type refrigeration cycle 10 is not limited thereto. For example, the ejector refrigeration cycle 10 may be applied to, for example, a stationary air-conditioning system, a cold storage warehouse, a cooling heating device for vending machine, etc.

(6) In the above embodiment, the valve body 35 formed into a substantially conical shape has been applied. The refrigerant passage formed between the inner peripheral surface of the decompression space 30*b* and the outer peripheral surface of the valve body 35 may be applied with a spherical valve body if the convergent part and the divergent part 132 can be formed.

(7) In the above embodiment, an example in which a subcooling heat exchanger is employed has been described. Alternatively, an normal heat radiator having only the condensing part 12*a* may be applied.

Figure 7:
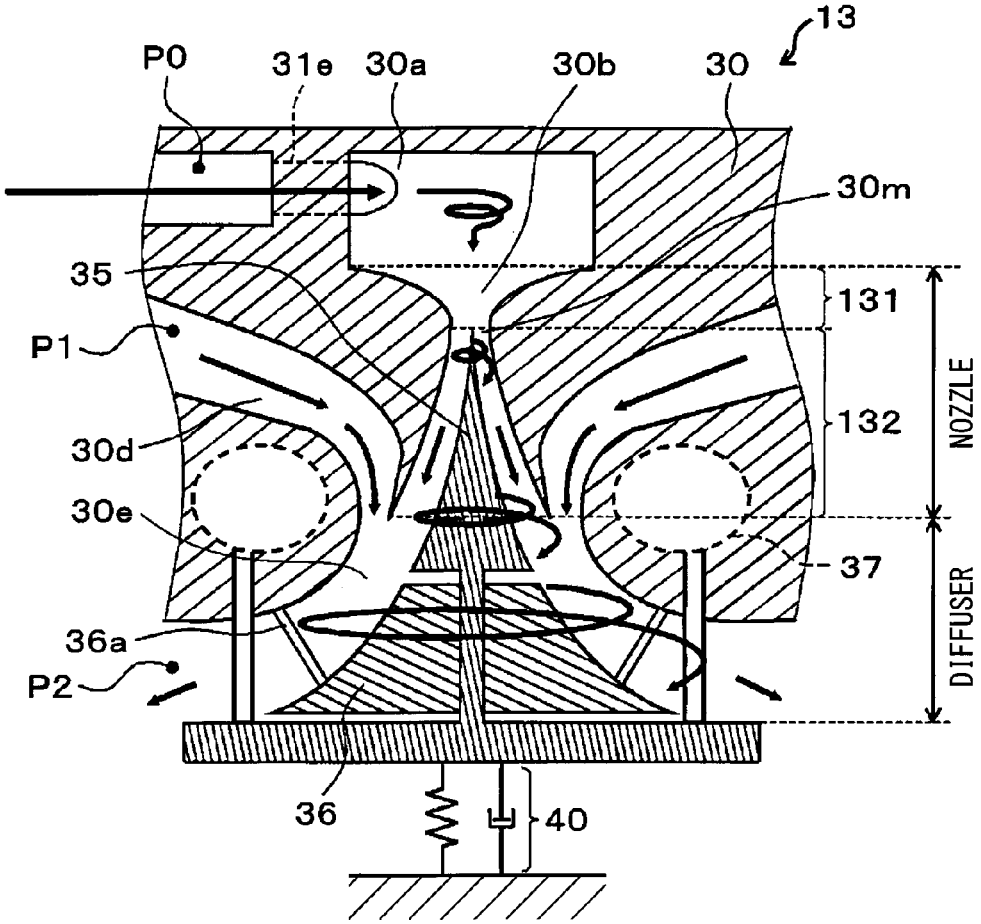
FIG. 7 is a schematic cross-sectional diagram of an ejector according to one modification of the present disclosure.
Figure 8:
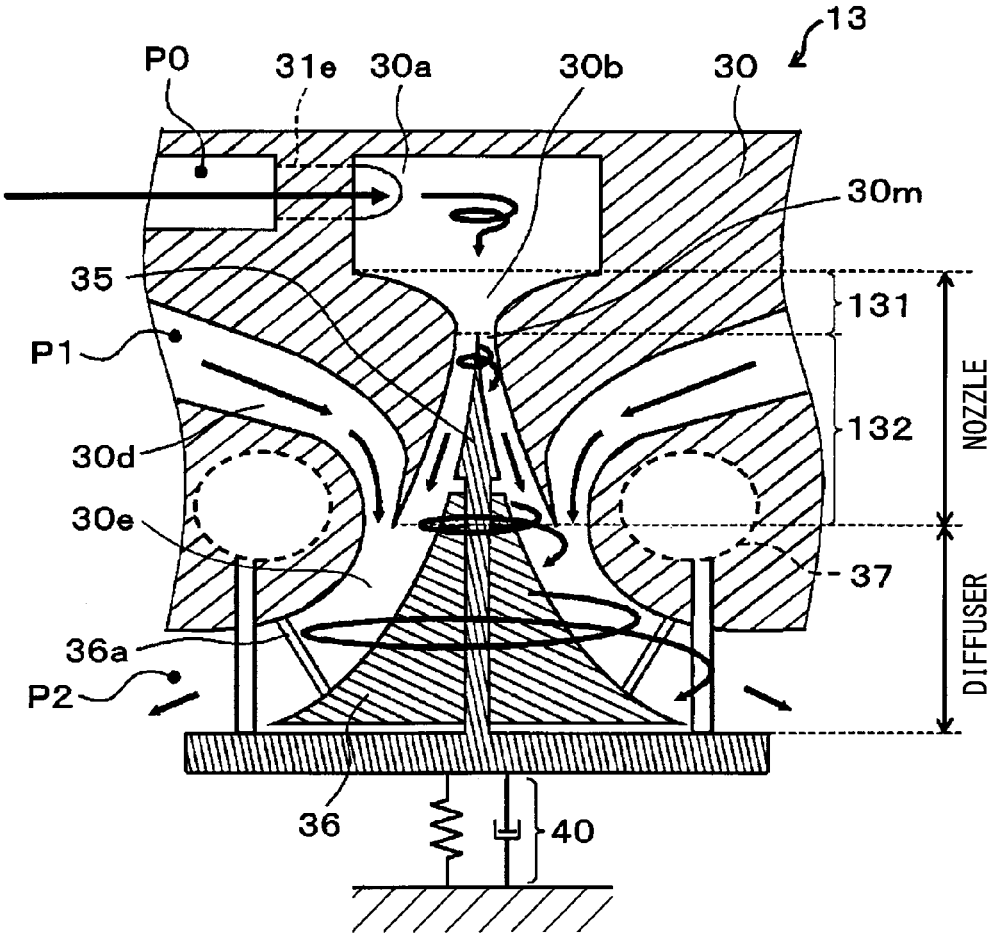
FIG. 8 is a schematic cross-sectional diagram of an ejector according to another modification of the present disclosure.

As in one modification of the present disclosure illustrated in FIG. 7, a part of the valve body 35 may partition a part of the refrigerant passage within the pressure increase space 30*e*. Also, as in one modification of the present disclosure illustrated in FIG. 8, a part of the passage formation member 36 may partition a part of the divergent part 132 within the decompression space 30*b*.

What is claimed is:

1. An ejector for use in a refrigeration cycle device of a vapor compression type, the ejector comprising:

a body part including a refrigerant inlet into which a refrigerant flows, a swirling space in which the refrigerant flowing from the refrigerant inlet swirls, a decompression space in which the refrigerant flowing out of the swirling space is decompressed, a suction passage that communicates with a refrigerant flow downstream side of the decompression space and is a space into which the refrigerant is drawn from an external, and a pressure increase space in which the refrigerant ejected from the decompression space is mixed with the refrigerant drawn from the suction passage;

a valve body that is disposed in the decompression space;

a passage formation member that is disposed in the pressure increase space and defines a refrigerant passage having a refrigerant passage area gradually expanding toward a downstream side in the refrigerant flow in the pressure increase space; and a drive device that displaces the valve body, wherein the decompression space has a minimum area part smallest in cross-sectional area in a refrigerant passage, the drive device displaces the valve body to change the cross-sectional area of the minimum area part in the refrigerant passage, the refrigerant passage defined by an outer peripheral surface of the valve body functions as a nozzle that decompresses the refrigerant flowing out of the swirling space and ejects the refrigerant, the refrigerant passage defined by an outer peripheral surface of the passage formation member functions as a diffuser that converts velocity energies of the ejected refrigerant and the drawn refrigerant into a pressure energy, the valve body and the passage formation member are provided as separated members; and the pressure increase space and the passage formation member are each formed into a rotating body shape and each have a shape expanding gradually and radially toward the downstream side in the refrigerant flow.

2. The ejector according to claim 1, wherein the passage formation member includes legs fixed to the body part, and two of the legs, adjacent to each other, have therebetween a refrigerant passage in which the refrigerant flows.

3. The ejector according to claim 1, wherein the passage formation member is coupled with the valve body through a vibration buffering member.

4. The ejector according to claim 1, wherein the body part further includes a gas-liquid separation space in which the refrigerant flowing out of the pressure increase space is separated into gas and liquid.

5. The ejector according to claim 1, wherein the valve body and the passage formation member are arranged to have a predetermined gap between the valve body and the passage formation member.

6. An ejector for use in a refrigeration cycle device of a vapor compression type, the ejector comprising:

a body part including a refrigerant inlet into which a refrigerant flows, a swirling space in which the refrigerant flowing from the refrigerant inlet swirls, a decompression space in which the refrigerant flowing out of the swirling space is decompressed, a suction passage that communicates with a refrigerant flow downstream side of the decompression space and is a space into which the refrigerant is drawn from an external, and a pressure increase space in which the refrigerant ejected from the decompression space is mixed with the refrigerant drawn from the suction passage;

a valve body that is disposed in the decompression space;

a passage formation member that is disposed in the pressure increase space and defines a refrigerant passage having a refrigerant passage area gradually expanding toward a downstream side in the refrigerant flow in the pressure increase space; and a drive device that displaces the valve body, wherein the decompression space has a minimum area part smallest in cross-sectional area in a refrigerant passage, the drive device displaces the valve body to change the cross-sectional area of the minimum area part in the refrigerant passage, the refrigerant passage defined by an outer peripheral surface of the valve body functions as a nozzle that decompresses the refrigerant flowing out of the swirling space and ejects the refrigerant, the refrigerant passage defined by an outer peripheral surface of the passage formation member functions as a diffuser that converts velocity energies of the ejected refrigerant and the drawn refrigerant into a pressure energy, the valve body and the passage formation member are provided as separated members; and the passage formation member is coupled with the valve body through a vibration buffering member.

7. The ejector according to claim 6, wherein the passage formation member includes legs fixed to the body part, and two of the legs, adjacent to each other, have therebetween a refrigerant passage in which the refrigerant flows.

8. The ejector according to claim 6, wherein the body part further includes a gas-liquid separation space in which the refrigerant flowing out of the pressure increase space is separated into gas and liquid.

9. The ejector according to claim 6, wherein the valve body and the passage formation member are arranged to have a predetermined gap between the valve body and the passage formation member.

* * * * *